United States Patent [19]

Gibellino et al.

[11] Patent Number: 4,716,826

[45] Date of Patent: Jan. 5, 1988

[54] INSTANTANEOUS ADJUSTMENT DEVICE FOR A DOTORING BLADE ASSEMBLY OPERATIVELY LINKED TO A CYLINDER IN A PRINTING PRESS

[75] Inventors: Gianfranco Gibellino, Trino Vercellese; Mario Forno, Casale Monferrato, both of Italy

[73] Assignee: Officine Meccaniche Giovanni Cerutti S.p.A., Casale Monferrato, Italy

[21] Appl. No.: 759,140

[22] Filed: Jul. 26, 1985

[51] Int. Cl.[4] ..... B41F 1/00

[52] U.S. Cl. ..... 101/169

[58] Field of Search ..... 101/169, 157, DIG. 26, 101/425, 363–366; 15/256.51, 256.53; 118/261, 245, 413

[56] References Cited

U.S. PATENT DOCUMENTS

| | | | |
|---|---|---|---|
| 3,128,207 | 4/1964 | Schmitt | 101/169 |
| 3,361,059 | 1/1968 | Klinger | 101/169 |
| 3,822,642 | 7/1974 | Grindeland | 101/169 |
| 4,170,177 | 10/1979 | Iida et al. | 101/169 |
| 4,311,094 | 1/1982 | Ellison | 101/169 |
| 4,398,463 | 8/1983 | Yessler, II | 101/169 |
| 4,463,675 | 8/1984 | Ottenhues | 101/169 |

FOREIGN PATENT DOCUMENTS

| | | | |
|---|---|---|---|
| 53298 | 6/1982 | European Pat. Off. | 101/365 |
| 3201178 | 7/1983 | Fed. Rep. of Germany | 101/169 |
| 2032749 | 11/1970 | France | 101/169 |
| 345658 | 5/1960 | Switzerland | 101/157 |
| 1222700 | 2/1971 | United Kingdom | 101/169 |

*Primary Examiner*—E. H. Eickholt

*Attorney, Agent, or Firm*—Romney Golant Martin Seldon & Ashen

[57] ABSTRACT

An instantaneous adjustment device for a doctoring blade assembly operatively linked to a cylinder in a printing press is provided which includes, interposed to the piston rod of a cylinder-piston unit actuated by compressed air and the oscillating holder assembly accommodating the doctoring blade, a mechanical means, such as a spring for storing up a force, and/or a means effective to periodically transfer an impact force to the doctoring blade oscillating holder.

13 Claims, 5 Drawing Figures

INSTANTANEOUS ADJUSTMENT DEVICE FOR A DOTORING BLADE ASSEMBLY OPERATIVELY LINKED TO A CYLINDER IN A PRINTING PRESS

BACKGROUND OF THE INVENTION

This invention relates to an instantaneous adjustment device for a doctoring blade assembly operatively linked to a cylinder in a printing press.

It is a known fact that the composition rollers of printing presses, and especially rotary presses, for example, incorporate doctoring blade assemblies which have, on their side confronting the rotating cylinder, a doctoring blade comprising a thin and highly flexible blade whose end is made to rest on the skirt surface of the rotating cylinder. Said doctoring blade is carried on an oscillating assembly which has, on its remote side from the doctoring blade, a rigid overhanging arm to which the end of a rod forming a part of a cylinder-piston assembly is connected. By supplying said cylinder with compressed air, for example, at a preset pressure level, it can be arranged that the knife edge of the blade bears on the cylinder at all times with a desired operating pressure. That pressure should be neither too low nor too high, if the doctoring blade is to constantly exert a desired pressure on the cylinder, an excessively high pressure being, however, to be avoided not to damage the cylinder.

It has now been found that, with such adjustment units linked operatively to the doctoring blade, after a few thousandths of a millimeter have been lost by the knife edge of the doctoring blade to wear, the gap between the rotating cylinder and doctoring blade increases undesirably, since the frictional forces developed, for instance, between the air-operated cylinder and respective piston are of such magnitudes as to inhibit an immediate compensation for the increase, within the range of a few thousandths of a millimeter, in the gap between the skirt of the rotating cylinder and the doctoring blade knife edge. It is necessary for the gap to become wider such that the slit may grow to a suitable size for the inertia of the adjustment cylinder-piston to be overcome and the cylinder-piston advanced by a very small amount to again press the doctoring blade knife edge against the skirt of the rotating cylinder. This inertia of the adjustment or bias system which acts on the doctoring blade assembly is the more significant the denser is the ink being used.

An increased gap between the rotating cylinder and knife edge of the doctoring blade, beyond a given size, however, brings about an undesired ink residue formation on the rotating cylinder, which results in haze formations on the printed product constituting a serious print defect yielding an inferior quality product.

SUMMARY OF THE INVENTION

It is an object of this invention to obviate such prior shortcomings by providing a means whereby the cited inertia can be simply and effectively eliminated from an adjustment device for a doctoring blade assembly, in the presence of a very small amount of wear of the knife edge of the doctoring blade, to ensure that the latter will always rest true across the rotating cylinder circumference and produce a doctoring blade-to-cylinder gap having a desired size.

According to the invention, this object is achieved by that between the piston rod of the cylinder-piston unit and the oscillating holder assembly for the doctoring blade, there is interposed a mechanical means, such as a spring, for storing up a force, and/or a means is provided which transfers periodically an impact force to the oscillating doctoring blade holder.

With this arrangement, it becomes possible to improve the control and adjustment function of a conventional cylinder-piston assembly interposed to a support and an overhanging arm affixed to the oscillating doctoring blade holder.

By providing a force storage means, such as a spring means, placed between the piston rod of the cylinder-piston unit and the oscillating holder for the doctoring blade, or providing a device which transfers periodically impact forces to the oscillating holder for the doctoring blade, the undesired effects of the inertia of conventional adjustment systems can be eliminated.

BRIEF DESCRIPTION OF THE DRAWINGS

The invention will be further described herein below with reference to some exemplary embodiments thereof in conjunction with the accompanying illustrative drawings, where.

DESCRIPTION OF THE PREFERRED EMBODIMENTS

Figure 1:
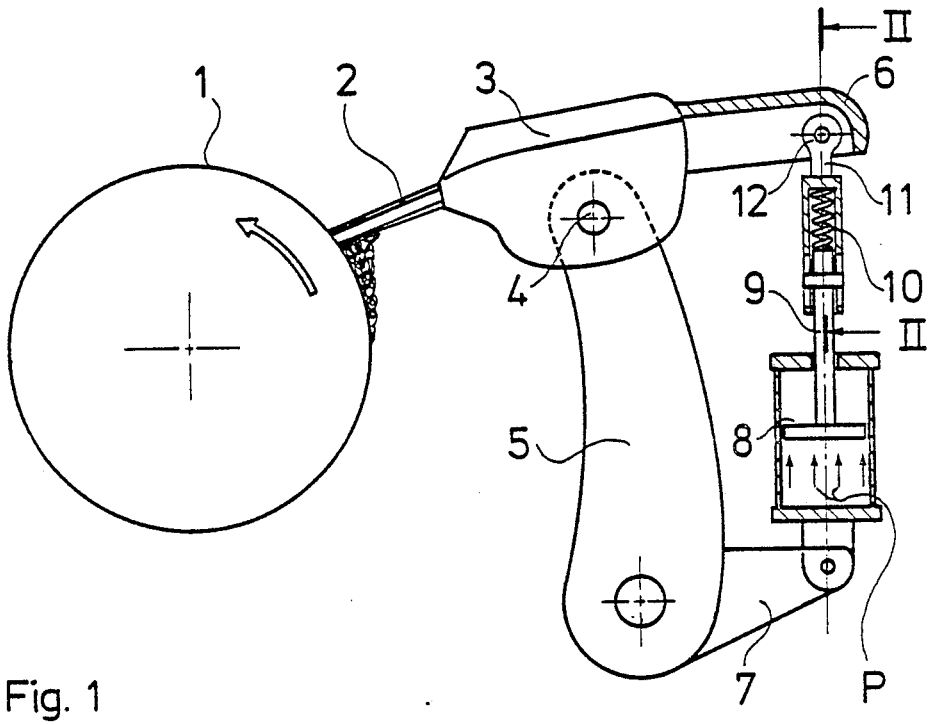
FIG. 1 is a diagrammatic view of a rotating cylinder of a printing press, to which the adjustment device of this invention is linked operatively.

As shown in FIG. 1, linked operatively to a rotating cylinder 1 of a printing press, in a manner known per se, is a doctoring blade 2 mounted on a holder 3 which can oscillate around a pivot pin 4 forming a part of a supporting arm 5 set approximately vertical. From the rear side of the holder 3 there juts out a cantilever-mounted arm 6, and at the bottom, the supporting or carrier arm 5 is made fast with a bracket 7. Said supporting bracket 7 accommodates a cylinder-piston unit 8 which is urged, such as by compressed air, to expand in the direction indicated by the arrows P. The compressed air pressure would be adjustable. The piston rod of the cylinder-piston unit 8, indicated at 9, rests, through an intervening coil spring 10, on a stem 11 which is connected to the overhanging arm 6 through a pin 12.

Figure 2:
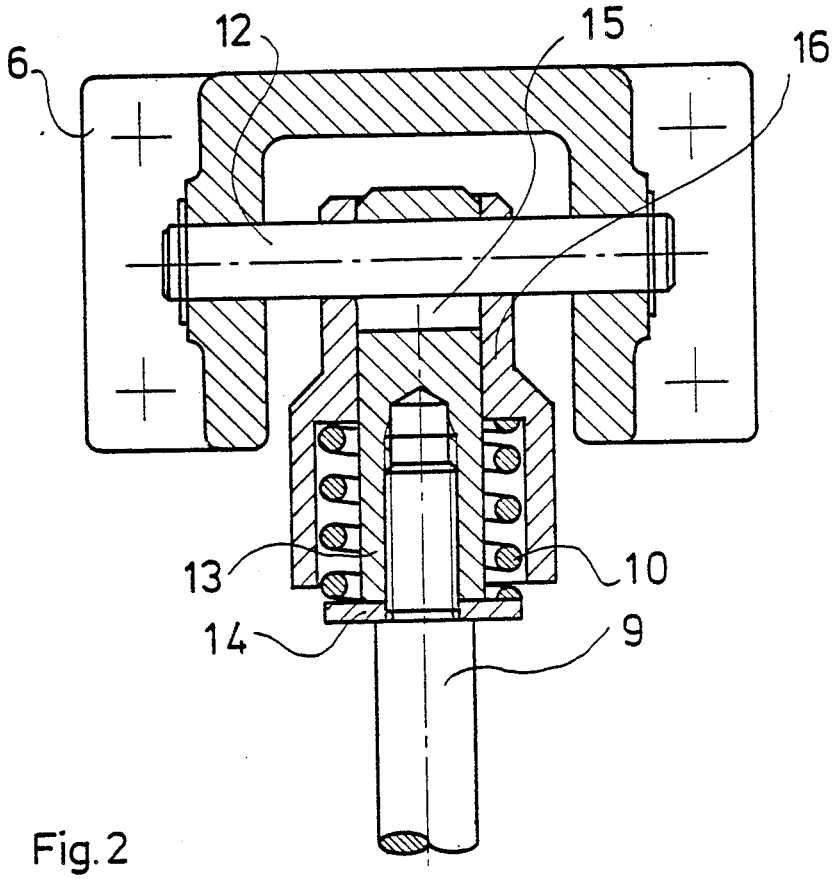
FIG. 2 is a sectional detail view taken along the line II—II in FIG. 1.

It may be seen from FIG. 2 that in detail the end of the rod 9 is threaded into a terminal socket 13 delimited at the bottom by a washer 14. The socket 13 has at the top a slot 15 wherethrough a pin 12 is passed loosely which is rigid with the overhanging arm 6. Against the washer 14 there bears in a freely detachable manner the coil spring 10, which is covered by a tubular body 16 the top end whereof is penetrated by the pin 12 in a close fit relationship therewith. The tubular body 16 is allowed to move freely with respect to the cylindrical socket 13. Thus, through the effect of the preloaded spring 10 and the slot 15, an unrestricted movement can be transferred to the pin 12 and hence to the overhanging arm 6.

Figure 3:
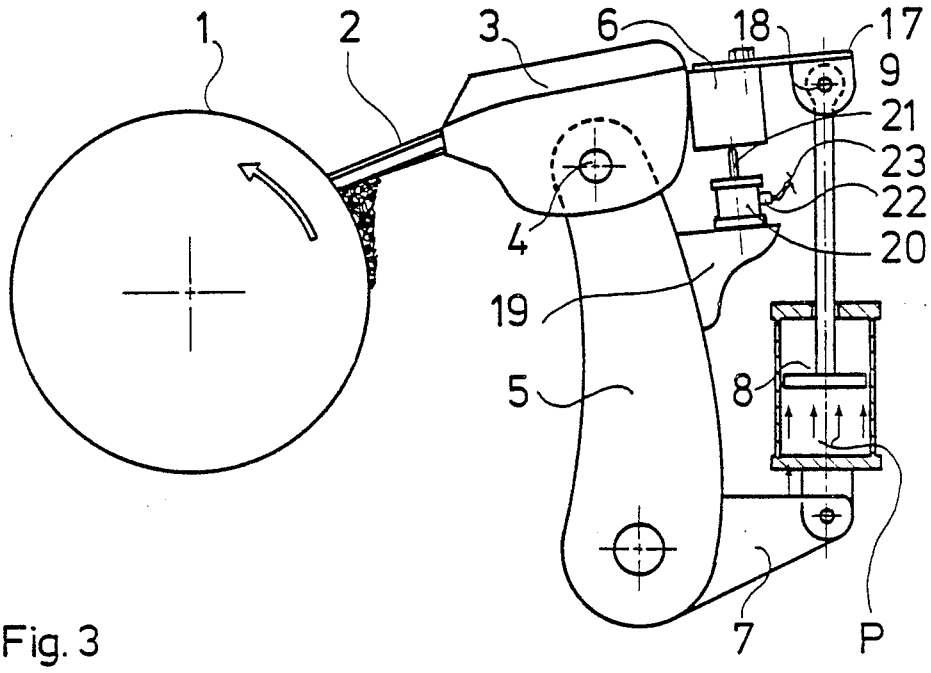
FIG. 3 shows the same device as in FIG. 1, but having the coil spring replaced with a leaf spring, and illustrates the provision of a device for transferring impact forces perpendicularly to the oscillating holder of the doctoring blade.

FIG. 3 shows a modified embodiment of the invention. The overhanging arm 6 attached to the oscillating holder 3 is here fast with a leaf spring 17 which is connected operatively to the rod 9 via swivel connection 18. Of course, the spring 17 may also be preloaded, just as the spring 10. Both the spring 10 in the embodiment of FIG. 1 and the leaf spring 17 in the embodiment of FIG. 3 form force storage means, which force can be released instantaneously without any inertial delay being involved, thereby the doctoring blade 2 would be kept adjusted even as the knife edge of the doctoring blade wears away by an amount within the range of a few thousandths of a millimeter.

It may also be seen from FIG. 3 that the vertical carrier arm 5 would be provided, where required, with an additional bracket 19 accommodating an air-operated cylinder 20 the piston rod 21 whereof is directed toward the overhanging arm 6. Operatively linked to the cylinder-piston unit 20 is a solenoid valve 22 for controlling it, and said solenoid valve is connected by leads 23 to a power source placed under the control, for example, of a computer or the like equipment conventionally employed for controlling modern rotary presses. On actuating the cylinder-piston unit 20, the rod 21 will strike, for example once or repeatedly, the arm 6 and transfer an impact force on the latter. This hammering action can be adjusted periodically, thus further relieving the inertiae present in the adjustment system. As an alternative, it would be possible to only use either the spring means 10,17 or the cylinder-piston unit 20 for transferring shocks to the arm 6 fast with the holder 3, or the spring members 17,10 may be combined with the hammering device 20. Of course, instead of the cylinder-piston unit 20, an electromagnet or equivalent actuator could be provided.

In lieu of the coil springs or of the leaf springs, a pack of Belleville washers could be used.

Figure 4:
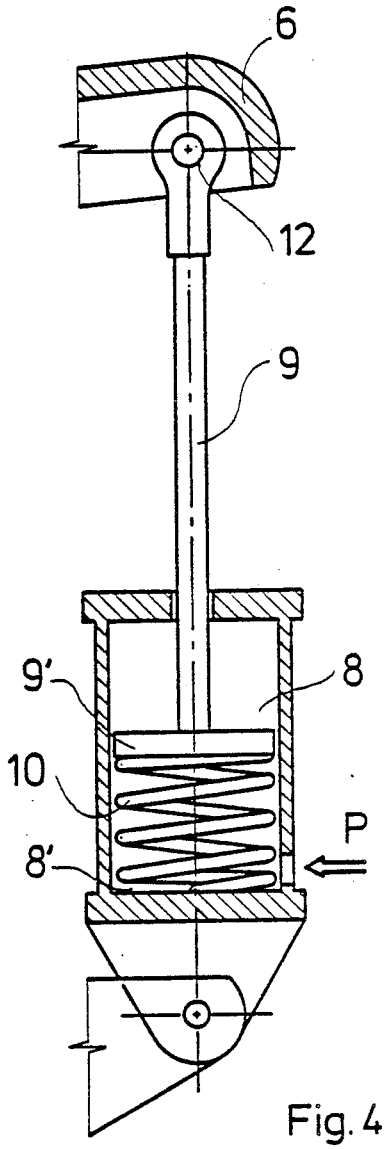
FIG. 4 shows diagramatically a further embodiment of the cylinder-piston unit as combined with a spring.

Shown in FIG. 4 is a further embodiment wherein the spring 10 is mounted inside the cylinder-piston unit 8, and specifically between the piston 9' and inner bottom 8' of the cylinder-piston unit, as indicated at 8. In this case, the spring would be housed within the cylinder-piston unit 8 in a well protected position, said spring 10 in no way affecting the flow of pressurized fluid P.

The device according to ths invention operates as follows.

Figure 5:
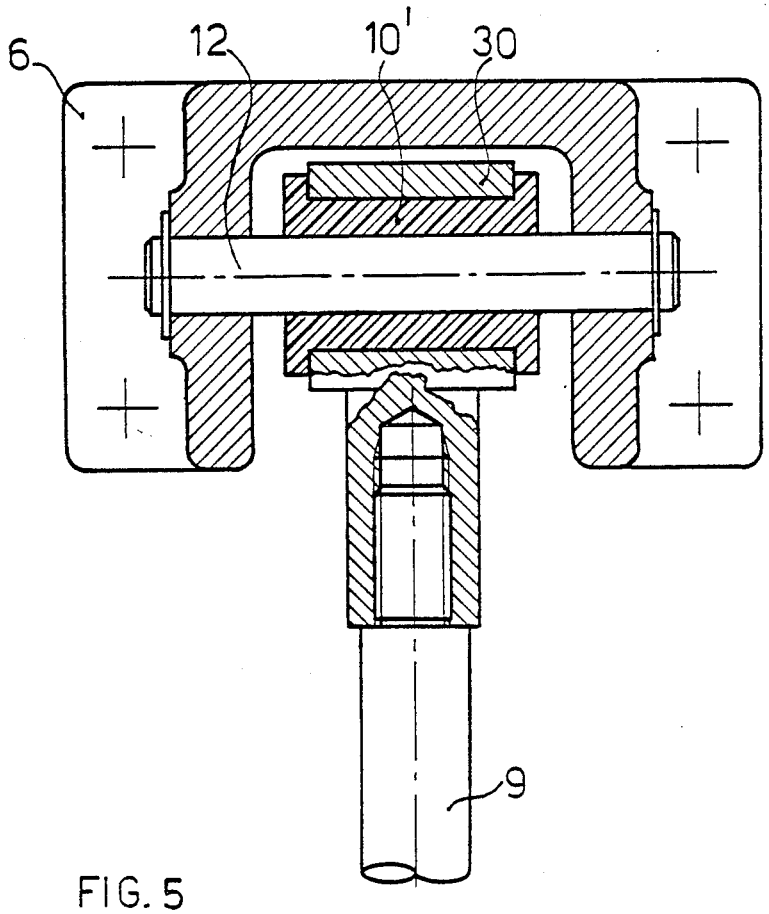
FIG. 5 shows the device wherein the spring is executed as a rubber spring.

As the doctoring blade 2 wear progresses by constant contact with the circumferential periphery of the rotating cylinder 1 to, for example, a few thousandths of a millimeter, the resulting increased gap could not be accommodated by the cylinder-piston unit 8 on account of the inertiae which occur, for example, between the piston and its seals, and the inner skirt of the cylinder. The preloaded spring elements acts instead with no inertia, and accordingly, readily and continuously accommodate the progressing wear of the knife edge of the doctoring blade 2. Through the device 20, comprising a hydraulic or pneumatic type of cylinder-piston unit, it also becomes possible to periodically transfer impact energy on the overhanging arm 6 fast with the holder 3, thereby any other inertiae due to friction through the system can be suppressed immediately and the knife edge of the doctoring blade 2 held at all times pressed against the skirt of the cylinder 1 with a desired force. Thus, the gap between the doctoring blade 2 and cylinder 1 is always kept constant, since a wearing effect would be compensated for at once, and any undesired haze avoided on the print. As shown in FIG. 5, as spring is also usable a rubber spring 10', placed in a housing 36 connected at the end of the rod 9 of the piston. The rubber spring 10' is surrounding the pin 12 like a hose.

What is claimed is:

1. An instantaneously adjusted doctoring blade assembly operatively linked to a cylinder in a printing press, comprising:

a rotatably mounted holder assembly;

a doctoring blade held in the holder assembly and juxtaposed to the circumferential periphery of such printing-press cylinder;

a fluid-operated cylinder-and-piston unit which, during printing-press operation using the doctoring blade, continuously biases the holder assembly in a direction that causes the doctoring blade to be pressed against the periphery of the printing-press cylinder, said cylinder-and-piston unit being subject to objectionable static friction between its piston and cylinder, and further being subject to objectionable inertial delays in motion of the piston; and interposed between the cylinder-and-piston unit and the holder assembly for the doctoring blade, mechanical means, such as a spring, for storing up a force and for applying the force to directly and continuously bias the holder assembly in the same direction as does the cylinder-and-piston unit but with substantially negligible static friction and with substantially negligible inertial delays in motion;

whereby the mechanical means provide relatively rapid corrective adjustment of the blade position relative to the printing-press cylinder, as compared with the cylinder-and-piston unit acting alone.

2. A device according to claim 1, characterized in that said force storage means comprises a leaf spring.

3. A device according to claim 1, characterized in that said force storage means comprises a Belleville washer pack.

4. A device according to claim 1, wherein:

the cylinder-and-piston unit has a piston rod;

the holder assembly comprises an arm that overhangs the cylinder-and-piston unit;

mounted in the overhanging arm, near its end, is a pin;

the end of the piston rod is threaded into a terminal socket delimited at the bottom by a washer;

the terminal socket is formed at the top with a slot through which the pin is passed loosely; and on the washer there is arranged to rest in a freely detachable relationship a spring adapted to be covered by a tubular body set slidable relative to the terminal socket and engaging the pin in a tight fit.

5. A device according to claim 1, wherein:

the holder assembly comprises an arm that overhangs the cylinder-and-piston unit;

the arm is provided with a bracket accommodating the cylinder-and-piston unit; and the cylinder-and-piston unit includes a piston rod that is arranged to exert on said overhanging arm a hammering action.

6. A device according to claim 1 wherein:

a remote-controlled mechanism is linked operatively to the cylinder-and-piston unit or equivalent actuator.

7. A device according to claim 1, wherein:

the cylinder-and-piston unit includes a piston; and the spring is provided inside the cylinder-and-piston unit, between the piston and bottom of the cylinder-and-piston unit.

8. A device according to claim 1, wherein:

the spring is provided in the form of a rubber spring (10').

9. The instantaneously adjusted doctoring blade assembly of claim 1, further comprising:

means for periodically exerting on the holder assembly a hammering action.

10. The instantaneously adjusted doctoring blade assembly of claim 9, wherein:

the hammering-action exerting means comprise a second cylinder-and-piston unit disposed to exert said hammering action on the holder, and means for controlling fluid flow into and out of the piston to cause the second cylinder-and-piston unit to exert said hammering action.

11. The instantaneously adjusted doctoring blade assembly of claim 9, wherein:

the hammering-action exerting means comprise a magnet-and-solenoid combination disposed to exert said hammering action on the holder, together with means for controlling electrical currents in the solenoid to cause the magnet-and-solenoid combination to exert said hammering action.

12. An instantaneously adjusted doctoring blade assembly operatively linked to a cylinder in a printing press, comprising:

a rotatably mounted holder assembly;

a doctoring blade held in the holder assembly and juxtaposed to the circumferential periphery of such printing-press cylinder;

a fluid-operated cylinder-and-piston unit, disposed to bias the holder assembly in a direction that causes the doctoring blade to be pressed against the periphery of the printing-press cylinder, said cylinder-and-piston unit being subject to objectionable static friction between its piston and cylinder, and further being subject to objectionable inertial delays in motion of the piston; and interposed between the cylinder-and-piston unit and the holder assembly for the doctoring blade, mechanical means, such as a spring, for storing up a force and for applying the force to directly and continuously bias the holder assembly in the same direction as does the cylinder-and-piston unit but with substantially negligible static friction and with substantially negligible inertial delays in motion;

said mechanical force-storage-and applying means comprising a coil spring connected in series between the cylinder-and-piston unit and the holder assembly, to bias the holder assembly in the same direction as does the cylinder-and-piston unit;

whereby the mechanical means provide relatively rapid corrective adjustment of the blade position relative to the printing-press cylinder, as compared with the cylinder-and-piston unit acting alone.

13. The instantaneously adjusted doctoring blade assembly of claim 12, further comprising:

a link between the cylinder-and-piston unit and the holder assembly; and a guideway, defined within the link, or retaining the spring and permitting the spring to operate substantially freely while guiding the force applied by the spring in the same direction as the force applied by the cylinder-and-piston unit.

* * * * *